United States Patent [19]

Craig, Jr.

[11] 3,933,222

[45] Jan. 20, 1976

[54] LADDER LEVELER

[75] Inventor: Coba C. Craig, Jr., Lexington, Ky.

[73] Assignees: James E. Jenkins; Joseph L. Moore; Coba C. Craig, all of Lexington, Ky. ; part interest to each

[22] Filed: Sept. 25, 1974

[21] Appl. No.: 509,304

[52] U.S. Cl. ..... 182/204; 403/109; 403/363

[51] Int. Cl.[2] ..... E06C 7/44

[58] Field of Search ..... 182/204, 205, 201, 202, 182/210, 211, 184, 209

[56] References Cited

UNITED STATES PATENTS

| | | | |
|---|---|---|---|
| 1,179,391 | 4/1916 | Bachman | 182/204 |
| 1,246,709 | 11/1917 | Brown | 182/204 |
| 1,359,297 | 11/1920 | Voss | 182/209 |
| 2,350,116 | 5/1944 | Kimes | 182/201 |
| 2,417,646 | 3/1947 | Hallner | 403/108 |
| 2,899,011 | 8/1959 | Babits | 182/120 |
| 2,936,849 | 5/1960 | Larson | 182/204 |

*Primary Examiner*—Reinaldo P. Machado
*Attorney, Agent, or Firm*—Wood, Herron & Evans

[57] ABSTRACT

A ladder having an adjustable extension enabling it to be positioned stably on uneven ground. The extension is telescopingly mounted on the outside of one leg of the ladder, and is slidable relative to the ladder leg in the longitudinal direction. Its range of movement is not limited by the ladder rungs. Locking means are selectively engageable in a series of holes to hold the extension in desired position.

2 Claims, 5 Drawing Figures

LADDER LEVELER

This invention relates to an adjustable extension which is easily mountable to a conventional ladder for extending the effective length of one leg of the ladder, to enable the ladder to rest stably on uneven ground.

If a ladder is set up on ground which is uneven or sloping with the ground elevation differing at the two legs, the ladder will inherently be unstable and will tend to tip sideways in use. Ladder levelers are known whereby one or, in some cases, both legs of the ladder can be adjusted or effectively lengthened to conform to the irregularity or slope of the ground, so that the ladder can be set up in a stable attitude.

U.S. Pat. No. 1,043,172 shows a simple type of extension wherein an extension is held in place, on a ladder leg, by a clamping screw. U.S. Pat. No. 2,481,581 shows a stepladder in which an extension is slidably captured between a ladder leg and a guide channel secured on the leg, and is held in place by a locking screw. U.S. Pat. No. 3,037,581 shows a leveler of telescoping arrangement which requires a ladder with special structure in place of the usual lower rung. U.S. Pat. No. 3,554,321 shows a relatively complex arrangements requiring both fixed and sliding channels.

It has been a purpose of this invention to provide a ladder leveler which is not limited in its range of movement by the first or lowermost rung of the ladder, and which is very secure and of easily adjustable telescoping configuration.

The leveler of this invention may be used on ladders having legs which are rectangular in cross section, e.g., conventional wooden leg ladders, as well as ladders wherein the legs are formed of metal extrusion of block "C" or "I" cross section. An extension is mounted to at least one leg of the ladder, and is in the form of a channel defined by a back wall and spaced side walls which extend from the back wall. The extension also includes retainer lips that extend from the respective side walls. The leg with which the extension is associated is slidably embraced in the channel and is retained therewithin by the retainer lips which extend from the side walls, so that the extension can slide, relative to the leg, only in the longitudinal direction. A lock for holding the extension in predetermined longitudinal position on the leg is mounted either to the extension or the leg and includes a finger which projects toward the other of the leg or the extension, and is selectively engageable in a series of longitudinally spaced holes therein to pin the extension in fixed position so that it cannot move. Preferably, the lock is mounted to the extension and includes a swing arm which is pivotally secured to the outside of the back wall of the channel, and is spring biased through an opening in the channel toward engagement with one of a series of holes formed in the leg.

The invention can best be further described and explained by reference to the accompanying drawings, in which FIG. 1 is an elevation of a ladder having, on one leg, a leveler in accordance with a preferred embodiment of the invention, showing the ladder resting stably on sloping ground;

Figure 1:
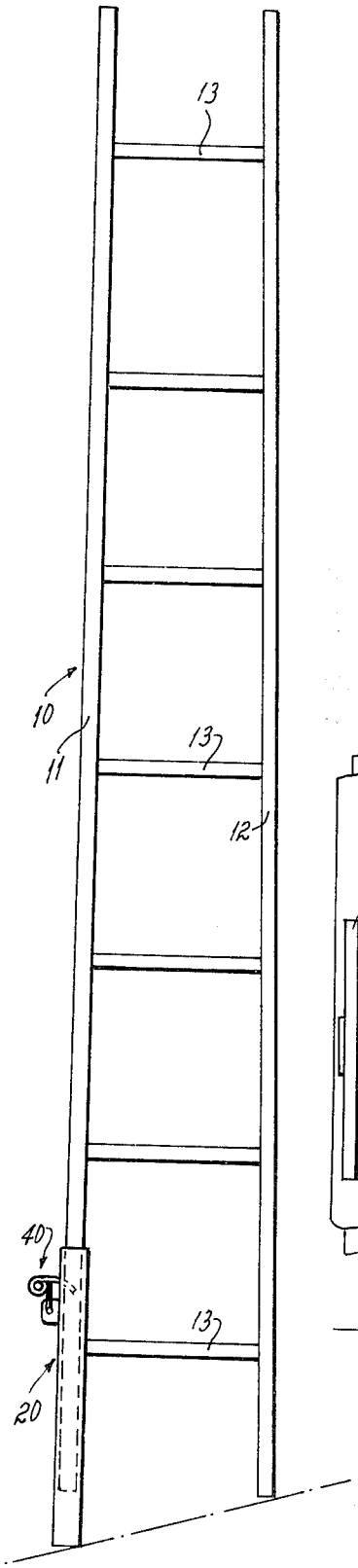
Figure 5:
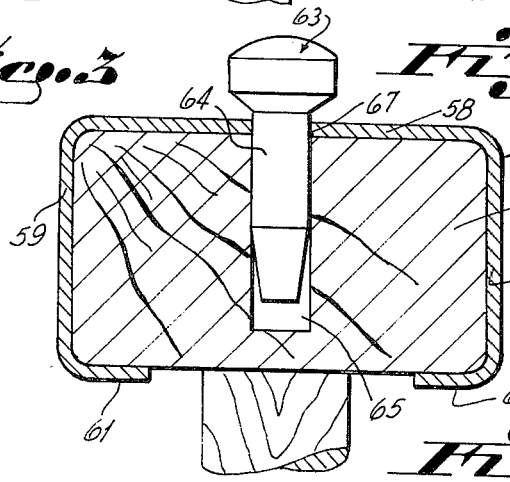
FIG. 5 is a horizontal cross section through a leg and extension in accordance with a modified embodiment of the invention for use with a ladder having solid wooden legs.

In FIG. 1 the ladder indicated generally at 10 includes two spaced legs 11 and 12 which are spaced apart and connected by horizontal rungs, each indicated at 13. In the particular embodiment shown, the legs 11 and 12 are assumed to be formed from extruded metal channels having the conventional sectional configuration shown in FIG. 4. (It should be noted however that the particular cross-sectional shape of the legs is not critical to the invention, and an alternative embodiment of the invention is illustrated in FIG. 5 for use with ladders having legs of another configuration.) The leg of the ladder shown in FIGS. 1–4 is channel shaped, having a back wall 15 and side walls or flanges 16 and 17 formed integrally with it and extending at right angles from it. The rungs 13 are fixed to the back wall 15 as by brazing or peening, as is known in the art, and do not project substantially beyond the outside surface 18 of the leg back wall 15.

At least one of the legs 11 and 12 (for example, the leg 11 as shown in FIG. 1) has an adjustable extension 20 mounted to it adjacent its lower end. The extension 20 surrounds and embraces the ladder leg so as to telescopingly slidable along it in the longitudinal (i.e., vertical or upright) direction. More particularly, extension 20 is channel shaped, having a back wall 25 and inside walls 26 and 27, and is sized and configured to embrace or nest the back and side walls 15, 16, and 17 respectively of ladder leg 11 (see FIG. 4).

For use with a ladder leg of the channel configuration shown in FIGS. 1–4, the side walls 26 and 27 of the extension 20 are provided with inturned retaining lips 30 and 31 respectively. These lips are formed integrally with the side walls, but are inturned toward the back wall 25, so that slots are defined in which the outer edges of the side walls 16 and 17 of the ladder leg are captured. The spacing is such that the extension can slide freely on the leg.

For the purpose of locking the extension in a desired position with respect to the leg, a lock designated generally at 40 is mounted to one or the other of the extension and the leg; in the drawing the lock is shown fastened on the back wall of the extension. Lock 40 includes a mounting bracket 41 having a pair of outwardly projecting spaced ears 42, 43. A locking element 45 having a finger grip in the form of a loop 46, is mounted to a swing arm 47. The arm 47 is bent (see FIG. 3) to form a right angular pivot pin 48 which is journaled in the ears 42, 43, and which thus is pivotable about an axis transverse to the rungs.

A series of holes, each designated at 49, are formed in the other one of the extension and the leg, e.g., in the leg in the embodiment shown. The holes shown extend through a wall of the leg, suitably but not necessarily parallel to the driection of the rungs 13. Preferably these holes are formed in the back wall 15 of the leg, vertically spaced apart in short increments.

Figure 2:
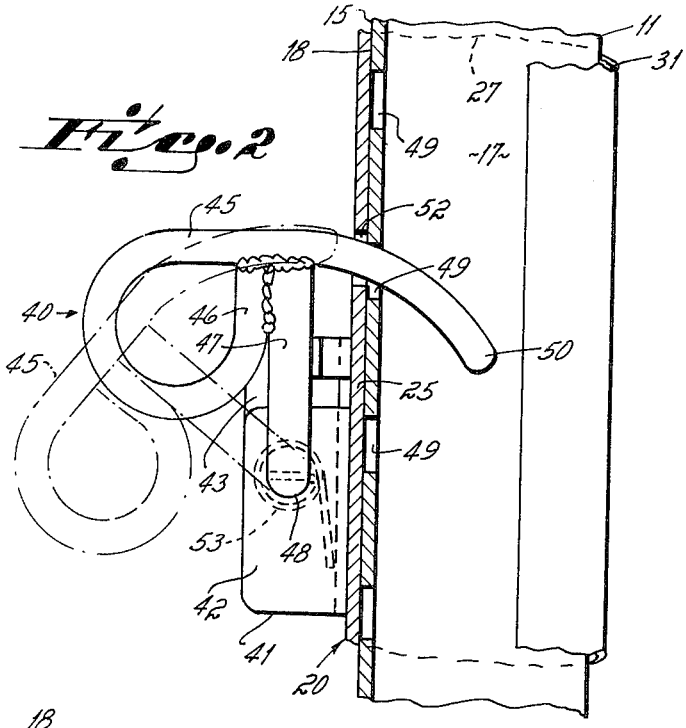
FIG. 2 is an enlarged fragmentary vertical section through a ladder leg and the extension thereon, the leg being in the form of a channel shaped extrusion, and showing the lock in locking position.
Figure 3:
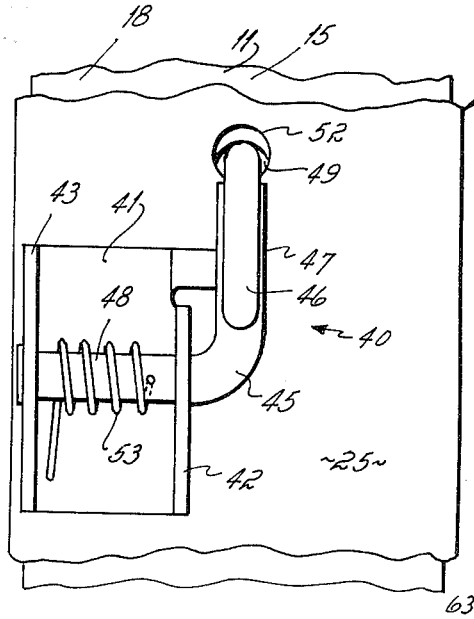
FIG. 3 is a fragmentary side elevation of the structure shown in FIG. 2.
Figure 4:
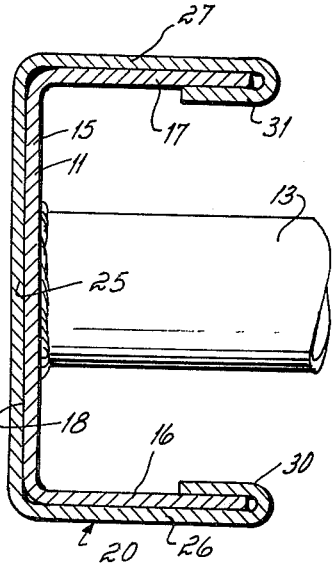
FIG. 4 is a horizontal cross section through the leg and extension shown in FIGS. 2 and 3, illustrating the movability of the extension past the rung.

In FIG. 2, it can be seen that the locking finger 45 includes a curved tip 50 having an axis of curvature which generally coincides with the axis of pivot pin 48.

The finger is swingable between the locking position shown in solid lines in the figure, and a release position shown in dash lines. In the locking position, tip 50 projects through an opening 52 in channel back wall 25, and through one of the ladder leg openings 49, which has been brought into alignment with the hole 52 by appropriately positioning the extension on the leg. A biasing spring 53 on pin 48 biases the locking element 45 toward the locked position shown. By pulling outwardly, that is, to the left in FIG. 2, on finger loop 46, the tip 50 can be withdrawn from the locked position so that the channel is not pinned to the leg and can be slid along it for adjustment according to the slope of the ground.

It should be noted that, by reason of the offset mounting of pin 48 with respect to plane of channel back wall 25, the tip 50 projects downwardly at an acute angle (rather than perpendicularly) through the openings 52 and 49. As a result, weight on the ladder leg tends to cam the tip 50 toward, rather than away from, locking position, so that the extension is securely locked and will not come unlocked unless the finger loop is deliberately pulled outward. This also tends to pull the extension tighter against the leg.

It will be apparent that the range of movement of the extension of the ladder is not limited by the position of the rungs 13, and that the extension can in fact be slid past the first (lowermost) rung, as shown in FIG. 1.

From this description, those skilled in the art will recognize that the lock can alternatively be mounted to the ladder leg, rather than on the extension as described, to engage holes in the extension.

An alternative embodiment of the invention is shown in FIG. 5, for use with a ladder having a wooden leg 56. In this case, the extension 57 includes a back wall 58 and side walls 59 and 60 that define the channel within which the leg is retained. Retaining lips 61 and 62 extend from the side walls 59 and 60, but in this case they extend parallel to the back wall 58 rather than toward the back wall as in the first described embodiment, and the channel defines a block "C" section in which the leg 56 is captured. An alternative locking mechanism 63 includes a finger 64 which is engageable within one of a series of holes 65 in leg 56 and which projects through an opening 67 in the extension back wall 58.

Having defined the invention what is claimed is:

1. A ladder leveler comprising, a ladder having a pair of parallel legs spaced apart by rungs which interconnect them, each of the said legs being channel shaped with spaced flanges projecting parallel to the rungs, at least one leg of the ladder having an adjustable extension mounted to it for extending the effective length of said leg to enable said ladder to rest stably on uneven ground, said extension being in the form of a channel having a back wall and spaced side walls extending from the back wall, said side walls projecting parallel to the said flanges of said one leg, said extension also including inturned retainer lips extending from the side walls and projecting reversely toward said back wall, the said one leg being slidably embraced within the channel and the respective flanges thereof retained between said retainer lips and the adjacent side walls, said extension permitting only longitudinally sliding movement of the leg with respect to it, and a lock for locking the longitudinal position of the extension of the leg, said lock being mounted to one of the extension and the leg, the other of the extension and the leg having a series of longitudinally spaced holes, said lock including a finger projecting through said one of said extension and leg and selectively engageable in the respective holes of said series to prevent movement of the extension on the leg.

2. The ladder leveler of claim 1 wherein said lock is mounted to one of the walls of said channel for pivotal movement about an axis parallel to but offset from the surface of said one wall, said finger being movable through an opening in such wall, and further wherein said finger does not project through said opening at a right angle but rather extends downwardly through it at an acute angle, such downward angulation thereby causing said finger to be cammed further through said opening in said wall when a downward load acts on said leg in use.

* * * * *